US005275028A

United States Patent [19]

Giarrante

[11] Patent Number: 5,275,028

[45] Date of Patent: Jan. 4, 1994

[54] PADLOCK PROTECTOR

[76] Inventor: Gary C. Giarrante, 300 Amendodge Dr., Shorewood, Ill. 60436

[21] Appl. No.: 28,903

[22] Filed: Mar. 8, 1993

[51] Int. Cl.[5] ..... E05B 67/38

[52] U.S. Cl. ..... 70/56; 220/339; 70/455

[58] Field of Search ..... 70/54–56; 70/455.2; 70/DIG. 43; DIG. 56; 220/324, 335, 339

[56] References Cited

U.S. PATENT DOCUMENTS

| | | | |
|---|---|---|---|
| 256,902 | 4/1882 | Kirk | 70/56 |
| 1,248,293 | 11/1917 | Ellington | 70/56 |
| 1,410,605 | 3/1922 | Schacht | 70/DIG. 56 X |
| 4,033,156 | 7/1977 | Cottingham | 70/56 |
| 4,134,280 | 1/1979 | Pelavin | 70/55 |
| 4,286,445 | 9/1981 | Sills | 70/55 |
| 4,651,543 | 3/1987 | Heald et al. | 70/54 |
| 4,879,889 | 11/1989 | DeForrest, Sr. | 70/56 |
| 5,003,795 | 4/1991 | Hoke | 70/55 |
| 5,037,000 | 8/1991 | Selame | 220/339 X |

*Primary Examiner*—Peter M. Cuomo
*Assistant Examiner*—Suzanne L. Dino
*Attorney, Agent, or Firm*—Ernest Kettelson

[57] ABSTRACT

A padlock protector to protect a padlock with its shackle through the staple of a hasp, comprising a three dimensional housing to receive the padlock therein, a closure member having an imperforate and integrally joined sealing structure around its periphery to prevent moisture from entering the housing from around the peripheral edge when the closure member is in its closed position, apertures to receive either a vertically or horizontally extending staple of a hasp or other lockable loop member through a wall of either the closure member or the housing to enter the cavity of the housing for the shackle of the padlock to lock, such staple receiving apertures having closure flaps, such closure flaps being integrally joined to the wall through which such apertures extend by an integral flexible hinge along a portion of the peripheral edge of such closure flaps and by an integral break-away web of thin cross-section along the remaining portion of such peripheral edge of the closure flaps. The housing and closure member are preferably transparent, and made of a shape retaining but compressible and somewhat flexible material.

13 Claims, 7 Drawing Sheets

PADLOCK PROTECTOR

BACKGROUND OF THE INVENTION

This invention relates to a protector for padlocks which will shield them from moisture such as rain and snow and from any other materials which may reach the lock if not covered or shielded from such contact. In particular, it relates to a protective enclosure which may also double as the package in which the padlock is offered for sale.

Prior art devices of this kind of which the inventor is aware include those disclosed in the following United States patents.

U.S. Pat. No. 5,003,795 discloses a lock protector comprising a notebook cover type of device, comprising a flat front cover and a flat back cover joined together along one edge by a flexible hinge, having top, bottom and side margins which are provided with cooperative fastening means such as hook and loop Velcro type fasteners or adhesive material which will hold the notebook cover type of device closed around the edges when the covers are folded together. A slot is provided in the back cover to receive the staple of a hasp locking member therethrough, which the shackle of a padlock is then placed through and locked. When the padlock is placed in position to lay flat against the back cover, the marginal edges around the front cover can then be pressed inwardly far enough to engage the cooperative fastening means around the marginal edges of the back cover while the interior portions of the front and back covers bulge out to accommodate the padlock sandwiched therebetween. Various modifications are disclosed including one having a pouch located below a vertical slot for the padlock to drop into, and a flap to cover the pouch, the vertical slot bisecting the hinge line between the flap and the panel on which the pouch is mounted.

U.S. Pat. No. 4,882,918 discloses a padlock cover having a retainer member to prevent movement of the body portion of the padlock within such cover It is particularly adapted for padlocks having a cylindrical combination unlocking mechanism.

U.S. Pat. No. 4,286,445 discloses a padlock protective cover comprising an enclosure having the peripheral configuration and dimension corresponding to that of the body portion of a padlock, and opening means for access to the key slot of the padlock o its other unlocking mechanism.

U.S. Pat. No. 4,033,156 discloses a cover for a padlock comprising a box-like enclosure having an opening through a side wall to receive the hinged arms of a hasp type of locking member, the locking end being received in the box with the padlock also being received in the box.

U.S. Pat. No. 3,458,113 discloses a plastic container having a closure lid secured to the container along one side edge by a pair of spaced apart integrally formed hinges.

U.S. Pat. No. 3,240,375 discloses a shipping and display container having a cover secured to the container along a side edge by a hinge which extends part way along the side edge, the display container having a pair of lugs on the hinged side to prevent the cover from pivoting one hundred and eighty degrees from the closed position to an opened position in which the cover would be substantially in line horizontally with the container.

U.S. Pat. No. 1,220,941 discloses a protector for padlocks comprising a metal channel type of cover, having a solid forwardly facing wall and solid side walls, an open rearwardly facing wall and an open bottom wall, the forwardly facing wall tapering toward the rearwardly facing open wall as it extends toward its upper edge, the upper edge being hinged to a plate which is secured to a door frame by screws. The hinged channel type of cover can be pivoted upwardly for access to a lock member and a padlock connected therein.

U.S. Pat. No. 1,136,582 discloses a lock shield in the form of a hood which is connected at its upper edge by a hinge to a hinge plate secured to a door or wall by screws, the hood being pivotable from a closed position in which it covers a padlock and lock member to an open position wherein the padlock and lock member are exposed for access thereto.

U.S. Pat. No. 416,433 discloses a padlock cover which is also in the form of a hood having its upper edge hinged to securing means which secures the cover device to a door or wall, the device covering a padlock and lock member when pivoted downwardly and uncovering when pivoted upwardly.

U.S. Pat. No. 256,902 discloses a padlock cover in the form of an ovular box having curved side walls, hinged to a hinge plate along the upper end, the hinge plate being securable to a door or wall by screws, the ovular box being pivotable between a closed position and an open position, covering the staple of a hasp type lock and shackle of a padlock through the staple when in the closed position and giving access thereto when in the open position.

The protector for padlocks in accordance with the present invention is an improvement over the prior art devices in this field. It provides a housing having a three dimensional cavity to receive a padlock, a closure member to close the cavity, a vertically extending aperture through the closure member to receive the staple of a hasp which extends vertically for the shackle of the padlock to extend through and lock, a horizontally extending aperture to receive the staple of a hasp which may extend horizontally, an integrally formed flexible hinge connecting the closure member to the housing, and an overlapping peripheral connecting member integrally formed around the peripheral edge of the closure member having an imperforate outwardly facing surface and an inwardly facing interlocking peripheral recess to receive a corresponding interlocking peripheral rib around the peripheral edge of the housing. When the closure member is in its closed position, the interlocking peripheral rib of the housing is received in the interlocking peripheral recess of the closure member to releasably interlock the closure member to the housing.

The outwardly facing imperforate surface of the integrally formed overlapping connecting member around the peripheral edge of the closure member provides a positive imperforate seal against moisture to prevent any moisture from entering the cavity of the housing around any part of its peripheral edge when the closure member is in its closed position.

To prevent moisture from entering the housing through the vertical and horizontal elongated apertures for the staple of a hasp, each is provided with a closure flap having one edge integrally joined to the closure member to provide an imperforate flexible hinge.

In the event any moisture enters the cavity of the housing when a staple of a hasp is extending through one of the apertures, a drain aperture is provided through the closure member below such staple receiving aperture having a drain aperture closure flap which in its open position extends inwardly of the cavity and inclined upwardly from an integrally joined flexible hinge along the bottom edge of the drain aperture closure flap which joins it to the closure member of the housing.

The staple receiving apertures are shown and described in this specification and drawings as being through the closure member. This invention encompasses various modifications which can be readily understood without unduly lengthening the specification with repetitive description and drawings. For example, the staple receiving apertures and the drain aperture with their corresponding closure flaps may be provided through the otherwise imperforate floor or outwardly facing bottom wall of the three dimensional housing.

The padlock protector in accordance with the present invention has the additional advantage of being able to double as the package in which a new padlock is shipped and sold. The housing and closure member are preferably transparent so the padlock inside is readily visible. The staple receiving apertures and drain aperture have their respective closure flaps originally sealed shut by imperforate integrally joined peripheral webs of thin cross-section. The webs will break away when separating pressure is applied to the closure flaps along respective portions of the break-away webs.

Further advantages of the padlock protector in accordance with the present invention will become apparent from the more detailed description which follows.

SUMMARY OF THE INVENTION

It is an object of the invention to provide a padlock protector having an imperforate peripheral sealing structure around its entire peripheral edge which will provide a continuous imperforate integrally formed moisture barrier around the periphery of the closure member when in its closed position on the housing which receives the padlock therein.

It is an object of the invention to provide a padlock protector which includes an elongated vertically extending aperture through the wall of either the closure member or the housing to receive a vertically extending staple of a hasp therethrough for the shackle of a padlock to lock within the cavity of the housing, and which also includes an elongated horizontally extending aperture through such wall to receive the staple of a hasp which may be extending horizontally.

It is an object of the invention to provide a padlock protector which includes a drain aperture and drain chute to drain any moisture from the cavity of the padlock protector housing which may enter through the staple receiving apertures when the staple of a hasp is extending therethrough.

It is an object of the invention to provide a padlock protector which is transparent and which can double as the package in which a new padlock may be shipped and offered for sale.

It is an object of the invention to provide a padlock protector having staple receiving apertures to receive the staple of a hasp therethrough and into the cavity of the padlock protector housing wherein such apertures are provided with a closure flap and a break away peripheral web to hold the closure flap in its closed position until separation pressure is applied to the closure flap along the break away peripheral web to cause it to break away and thereby move the closure flap to its open position.

DESCRIPTION OF PREFERRED EMBODIMENT

Figure 1:
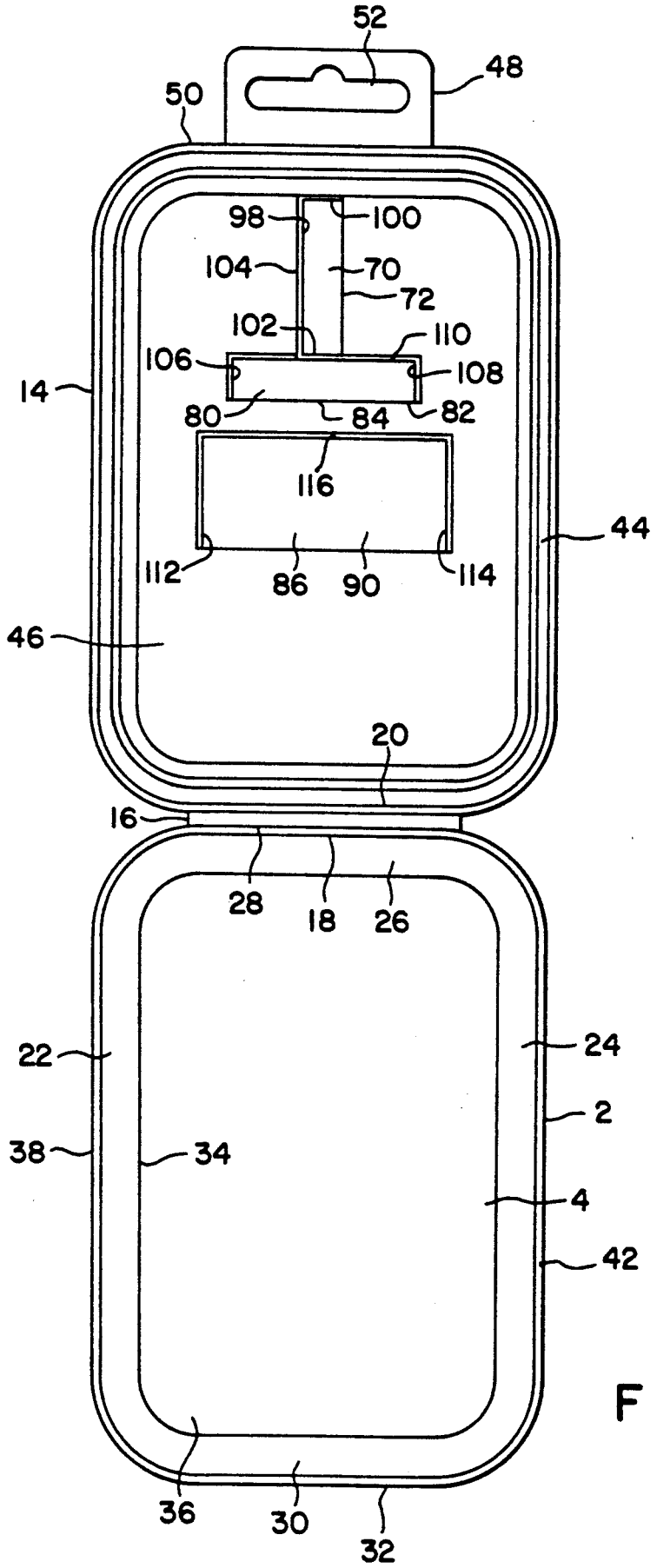
FIG. 1 is a plan view of the padlock protector in accordance with this invention shown with its closure member in the open position and showing the closure flaps for the apertures which receive the staple of a hasp or other lockable loop member therethrough in their closed position and the closure flap for the drain aperture also in its closed position.
Figure 2:
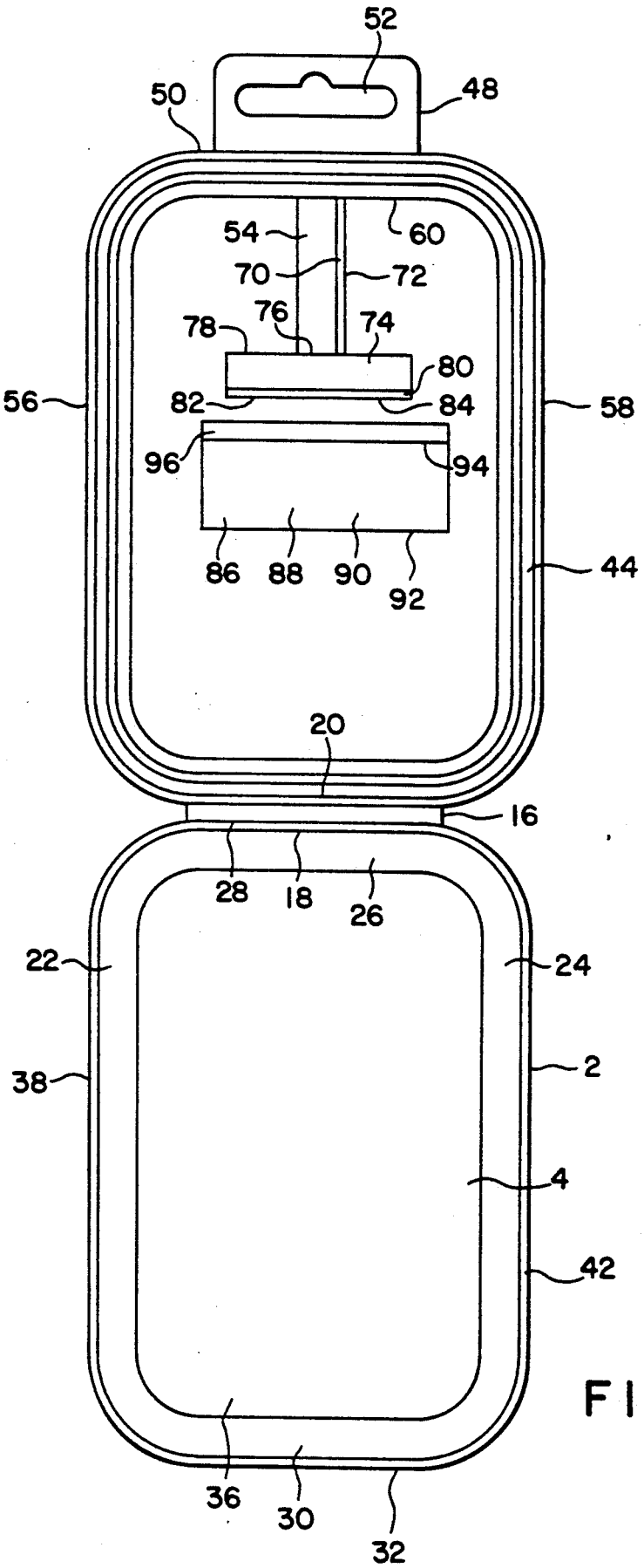
FIG. 2 is a plan view similar to FIG. 1, but showing the closure flaps for the staple receiving apertures and drain aperture in their open position.
Figure 3:
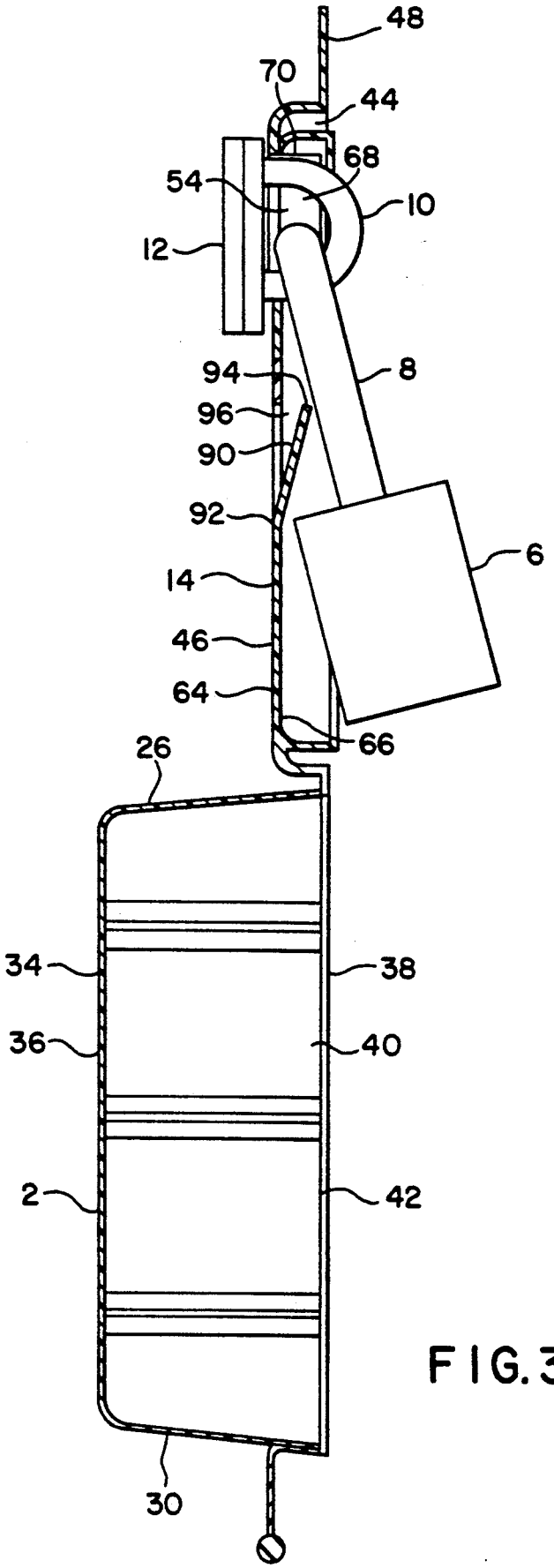
FIG. 3 is a section view of the padlock protector shown in FIGS. 1 and 2 but with the vertical staple receiving aperture open and the vertical staple of a hasp extending therethrough with the shackle of a padlock through the staple opening.
Figure 4:
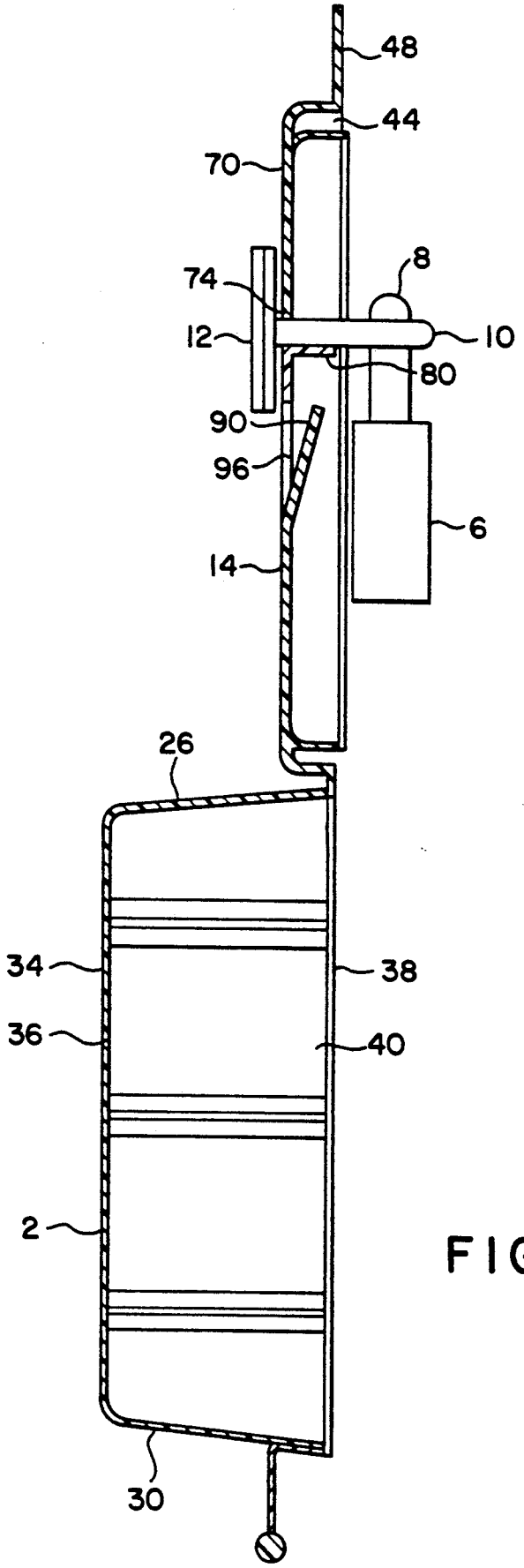
FIG. 4 is a section of the padlock protector shown in FIGS. 1 and 2 but with the horizontal staple receiving aperture open and the horizontal staple of a hasp extending therethrough with the shackle of a padlock through the staple opening.
Figure 5:
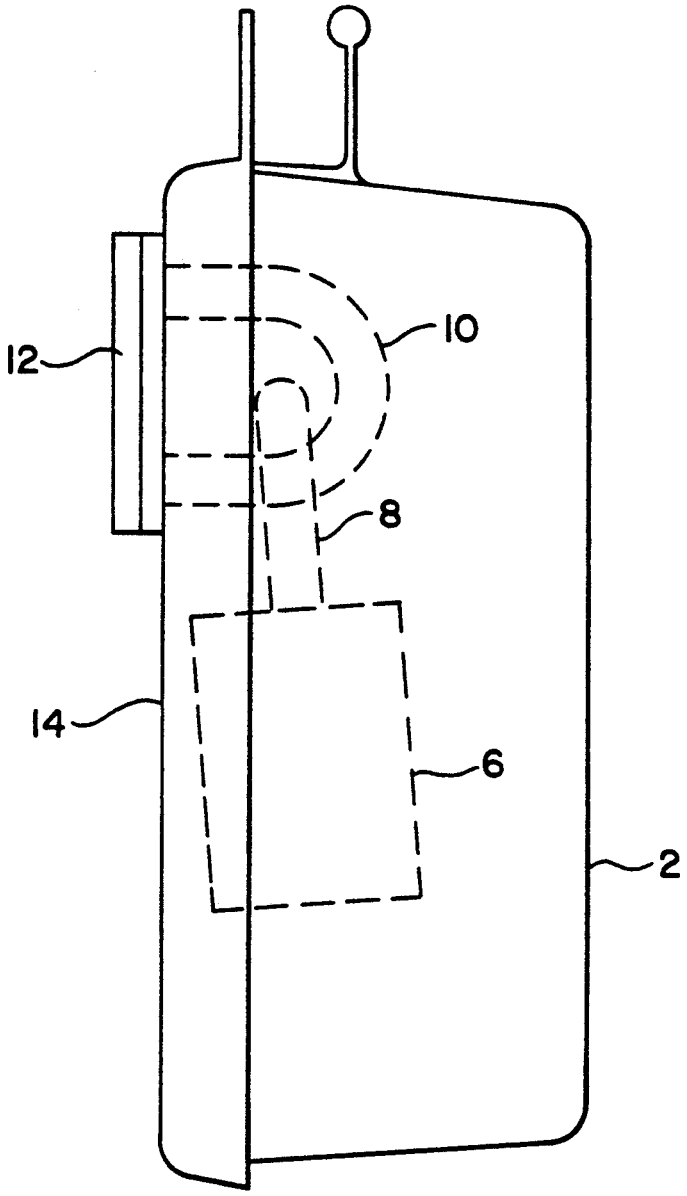
FIG. 5 is a side elevation view of a padlock protector in accordance with this invention showing the closure member in its closed position and a staple of a hasp with padlock connected thereto shown in phantom by broken lines enclosed within the cavity of the protective housing.
Figure 6:
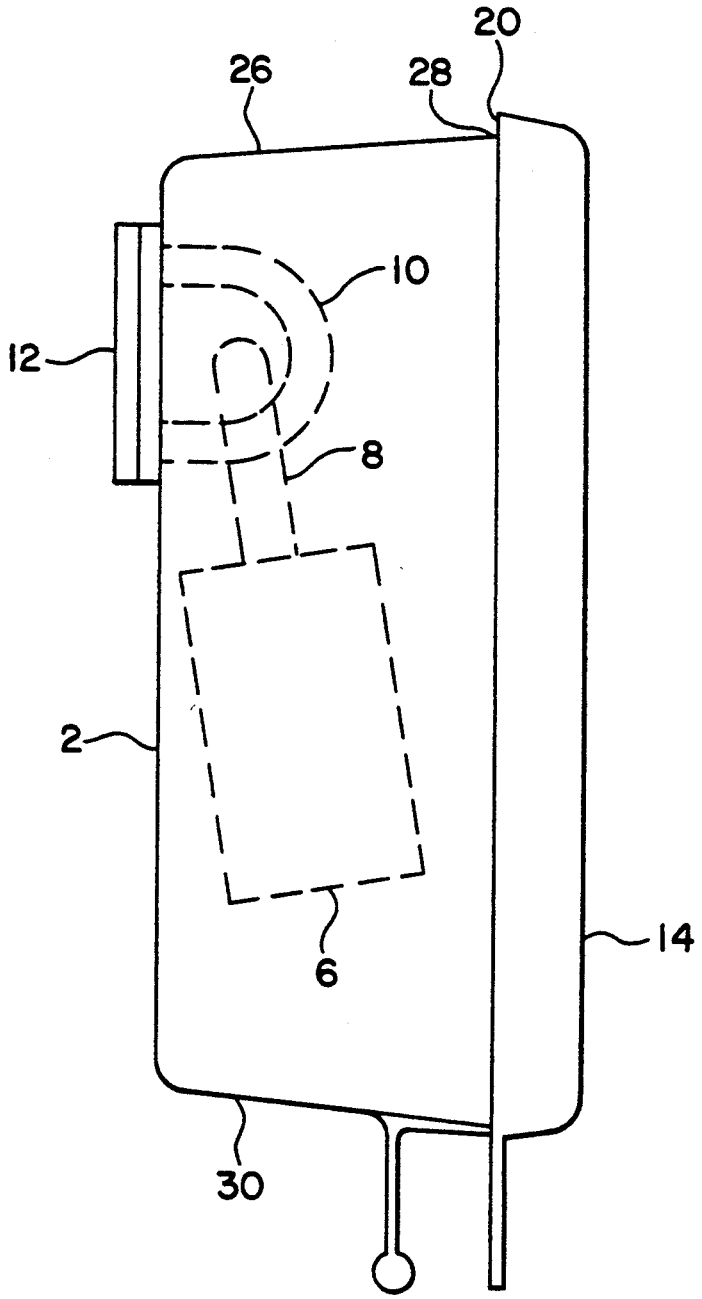
FIG. 6 is a side elevation view of a modified embodiment of the padlock protector in accordance with this invention wherein the staple receiving apertures and drain aperture are provided through the floor or bottom wall of the housing cavity rather than through the panel of the closure member, showing a staple of a hasp with padlock connected thereto in phantom by broken lines enclosed within the cavity of the protective housing.
Figure 7:
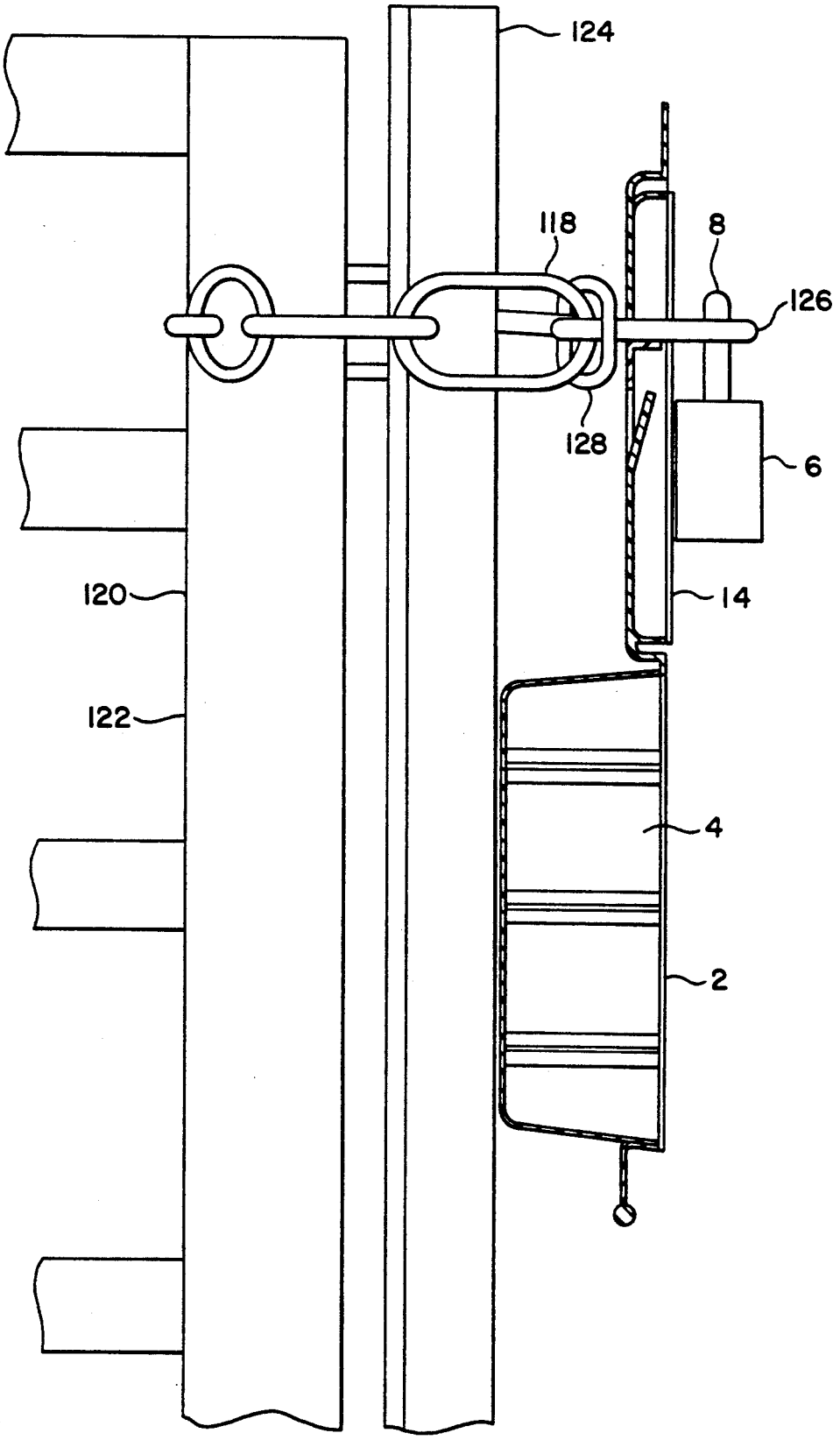
FIG. 7 is a section view of the padlock protector shown in FIGS. 1 and 2 with the horizontal staple or lockable loop receiving aperture open and the end link of a chain extending through such aperture and through the opposite end link of the chain which extends around a gate post and upright member of a gate, the shackle of a padlock shown in place through the chain link which extends through the staple or lockable loop receiving aperture.

A padlock protector in accordance with this invention comprises a housing 2 having a cavity 4 therein to receive a padlock 6 whose shackle 8 is in locking engagement with the staple 10 of a hasp 12. The housing 2 is connected to a closure member 14 by a flexible hinge 16 joined to the housing 2 along its connecting edge 18 and integrally joined to the closure member 14 along its connecting edge 20.

The housing 2 as shown and described herein has a substantially rectangular, continuous peripheral wall, comprising a pair of spaced apart elongated side walls 22 and 24, an end wall 26 extending between the side walls 22 and 24 at the connecting end 28 of the housing 2 adjacent its connection to the closure member 14. An oppositely disposed end wall 30 extends between the side walls 22 and 24 at the opposite end 32 of the housing 2.

The side walls 22 and 24 and end walls 26 and 30 are imperforate throughout and terminate at one end in a generally rectangular peripheral edge 34, where they are integrally joined around said peripheral edge 34 to a solid or imperforate protective wall 36. The side walls 22 and 24 and end walls 26 and 3 terminate at their opposite ends in a slightly larger generally rectangular peripheral edge 38 which bounds an open receiving wall 40 to receive the padlock 6 therethrough and into the cavity 4.

A peripheral rib 42 extends outwardly around the peripheral edge 38 to be received in a corresponding peripheral recess 44 of the closure member 14 when the housing 2 is pivoted on the flexible hinge 16 from an open position to a closed position. The peripheral rib 42 and peripheral recess 44 are slightly compressible and resilient, the configuration and the cross-sectional dimension of the rib 42 corresponds to that of the recess 44 for a snug fit when received therein, to releasably hold the housing 2 to the closure member 14 until a sufficient amount of force is applied to separate them.

The closure member 14 comprises a substantially planar panel 46 bounded by the peripheral recess 44 which opens in the direction facing the peripheral rib 42 of the housing 2 when in facing relationship. The closure member 14 is substantially rectangular, having a peripheral configuration and dimension corresponding to that of the open receiving wall 40 of the housing 2. The peripheral rib 42 around the open receiving wall 40 of the housing 2 and the peripheral recess 44 around the closure member 14 are in registration around their entire periphery when the housing 2 is pivoted to its closed position against the closure member 14.

The closure member 14 has an outwardly extending hanger tab 48 extending outwardly from the outer end edge 50 of the closure member 14. The outer edge 50 is parallel to and spaced apart from the connecting edge 20 at the opposite end of the closure member 14. The tab 48 is substantially rectangular and includes an elongated aperture 52 extending laterally of the tab 48.

A first lock receiving aperture 54 is provided through the panel 46 of the closure member 14, extending longitudinally thereof in the direction from the outer edge 50 toward the connecting edge 20. The first lock receiving aperture 54 is located midway between the side edges 56 and 58 of the closure member 14 and extends from the outer edge 60 of the panel 46 adjacent the corresponding outer edge 50 of the closure member 14. The longitudinal and cross-sectional dimension of the aperture 54 corresponds to the corresponding dimension of the staple 10 of a hasp 12, or other locking member of a locking device to be received through the aperture 54 from the rearwardly facing side 64 of the closure member 14 to extend from its forwardly facing side 66.

The shackle 8 of a padlock 6 may then be received through the central opening 68 of the staple 10 to lock the locking device, after which the housing 2 is pivoted to its closed position to receive the padlock 6 and locked staple 10 in the cavity 4 thereof to protect them from the weather. The peripheral rib 42 of the housing 2 is compressibly received in the peripheral recess 44 of the closure member 14 to releasably inter-lock and hold the housing 2 in its closed position.

A first closure flap 70 is provided to close the first lock receiving aperture 54 when nothing is received therethrough. The first closure flap 70 is integrally joined to the panel 46 of the closure member 14 along its longitudinal connecting edge by a first flap flexible hinge 72.

A second lock receiving aperture 74 is provided through the panel 46 of the closure member 14, extending laterally thereof in the direction from its side edge 5 toward its side edge 58, and is located midway therebetween at a position wherein the inner end edge 7 of the longitudinally extending first lock receiving aperture 54 is adjacent the laterally extending side edge 78 of the laterally extending aperture 74.

The lateral and cross-sectional dimension of the lateral aperture 74 corresponds to the corresponding dimensions of the staple 10 of the hasp 12 or other locking member of a locking device to be received through the lateral aperture 74 from the rearwardly facing side 64 of the closure member 14 to extend from its forwardly facing side 66.

A second closure flap 80 is provided to close the second lock receiving aperture 74 when nothing is received therethrough. The second closure flap 80 is integrally joined to the panel 46 of the closure member 14 along its laterally extending connecting side edge 82 by a second flap flexible hinge 84. The connecting side edge 82 of laterally extending aperture 74 is closer to the connecting end edge 20 of the closure member 14 than its opposite laterally extending side edge 78.

A moisture drain assembly 86 is provided on the panel 46 of the closure member 14, comprising a laterally extending chute 88 having a inclined wall 90 integrally connected to the panel 46 at its lower end 92 closest to the connecting edge 20 of the closure member 14, sloping outwardly and away from the panel 46 as it extends toward its upper end 94 which terminates at a spaced apart location just below the opposite laterally extending side edge 84 of the second lock receiving aperture 74.

The upper end 94 of the inclined chute wall 90 extends laterally of the panel 46 and substantially parallel to the side edge 82 of the laterally extending aperture 74. The chute wall 90 and its upper end 94 extend laterally beyond the aperture 74 at both opposite ends. An open wall outlet 96 extends through the panel 46 facing the inclined chute wall 90 and co-extensive therewith to provide a discharge outlet for the chute 88. Any moisture such as rain or snow which may be able to pass through one or the other of the lock receiving apertures 54 and 74 will drip downwardly when the padlock protector in accordance with this invention is in place to enclose a padlock and lock member therein. Such moisture will drip down on to the inclined chute wall 90, sliding downwardly thereon, and outwardly through the chute discharge opening comprising the open wall outlet 96.

The entire housing 2 and closure member 14 are preferably made of a transparent plastic material whereby the padlock in the cavity 4 can be readily seen. The padlock 6 can be placed in the cavity 4 with the housing 2 and closure member 14 in the closed position, and with the closure flaps 70 and 80 in their closed positions to close the respective lock receiving apertures 54 and 74. Such construction enables use of the padlock protector in accordance with this invention as the packages in which new padlocks may be placed for shipment and offered for sale. The closure flaps 70 and 80 and the inclined wall 90 of the chute 88 ar preferably sealed shut around their peripheral edges with weakened score lines or webs before being used to protect and enclose a padlock in locking engagement with a lock member.

The closure flap 70 is permanently integrally joined to the panel 46 along its longitudinal connecting side edge by the flexible hinge 72. Its opposite longitudinal side edge 98, and its end edges 100 and 102 are originally integrally joined to the panel 46 by a continuous weakened score line or web 104 extending therearound. The web 104 is of the same material as the panel 46 but has a smaller or thinner cross-section, sufficiently thin to break away along such score line or web when pressure is applied against the closure flap 70.

The closure flap 80 is permanently integrally joined to the panel 46 along its laterally extending connecting side edge 82 by the flexible hinge 84. Its opposite laterally extending side edge 78, and its end edges 106 and 108 are originally integrally joined to the panel 46 by a continuous weakened score line or web 110 extending therearound. The web 110 is of the same material as the panel 46 but has a smaller or thinner cross-section, sufficiently thin to break away along such score line or web when pressure is applied against the closure flap 80.

The inclined wall 90 of the chute 88 is permanently joined to the panel 46 along its lower end edge 92. Its opposite end edge 94, and its side edges 112 and 114 are originally integrally joined to the panel 46 by a continuous score line or web 116 extending therearound. The web 116 is of the same material as the panel 46 but has a smaller or thinner cross-section, sufficiently thin to break away along such score line or web when pressure is applied against the inclined wall 90. When pressed to break away along the score line or web 116, the inclined wall 90 will maintain its desired inclined position to form the chute 88 for draining any moisture through the now open wall outlet 96 that may enter through the lock receiving apertures 54 and 74 after their closure flaps 70 and 80 have been opened by breaking away from their respective score lines 104 and 110.

The padlock protector in accordance with this invention may also be used with locking devices other than a hasp 12 and its staple 10. For example, a link chain 118 may be wrapped around the upright leg 120 of a gate 122 and an adjacent post 124 to lock the gate shut, one link 126 of the chain extending through another link 128 and then through one of the lock receiving apertures 54 or 74. The shackle 8 of the padlock 6 is then received through the link 126 and locked, whereupon the closure member 14 is then moved to its closed position to enclose the padlock 6 and link 126 within the cavity 4 of the housing 2.

I claim:

1. A padlock enclosure comprising a three dimensional container having a peripheral side wall joined along a first peripheral edge to a protective wall extending transversely of said peripheral side wall, said peripheral side wall having a second peripheral edge spaced apart from said first peripheral edge, an open container wall defined by said second peripheral edge spaced apart from said protective wall and extending transversely of said peripheral side wall, a three dimensional cavity of said container to receive a padlock therein bounded by said peripheral side wall, said protective wall and said open container wall, a closure member connected to said container movable between a closed position and an open position, said closure member including a substantially planar panel having a peripheral configuration and dimension corresponding to that of said open container wall to close it when said closure member is in its said closed position and to open said open container wall when in its said open position, closure member connecting means to connect said closure member to said container, releasable holding means to releasably hold said closure member in its said closed position, a first receiving aperture through said panel of said closure member having a dimension and configuration to receive a lockable loop member therethrough, a first receiving aperture cover movable between a closed position to close said first receiving aperture and an opening position to open said first receiving aperture, and first cover connecting means to connect said first receiving aperture cover to said first receiving aperture, wherein said first receiving aperture cover has a peripheral configuration and dimension corresponding to that of said first receiving aperture, said first cover connecting means comprising a connecting web extending peripherally between and integrally joining the peripheral edge of said first receiving aperture cover to the corresponding peripheral edge of said first receiving aperture, said connecting web having a cross-sectional thickness which is less than the cross-sectional thickness of said panel of said closure member and of said first receiving aperture cover to enable separating said first receiving aperture cover from said first receiving aperture along portions of said connecting web at which separating pressure is applied to thereby open said first receiving aperture.

2. A padlock enclosure as set forth in claim 1, wherein said closure member connecting means which connects said closure member to said container includes an integral flexible closure member hinge along a first edge portion of said closure member connecting it to a corresponding first edge portion of said second peripheral edge of said container which defines said open container wall, said flexible closure member hinge terminating at a first end and at an opposite second end.

3. A padlock enclosure as set forth in claim 2, wherein said releasable holding means to releasably hold said closure member in its said closed position includes an inter-connecting peripheral rib which extend around that part of said second peripheral edge of said container which extends away from said first end of said integral flexible closure member hinge and around to said second end thereof, an inter-connecting peripheral recess which extends around that part of the peripheral edge of said closure member which extends away from said first end of said integral flexible closure member hinge and around to said second end thereof, said inter-connecting peripheral recess of said closure member being in registration with said inter-connecting peripheral rib of said container to receive and releasably hold it therein when said closure member is in its said closed position.

4. A padlock enclosure as set forth in claim 1, including a hanger tab extending therefrom, a hanger aperture through said hanger tab to receive a projecting hanger structure therethrough for hanging said padlock enclosure thereon.

5. A padlock enclosure as set forth in claim 1, wherein at least a portion of one of the components comprising said peripheral side wall, said protective wall, and said panel of said closure member is transparent to view a padlock within said cavity of said container.

6. A padlock enclosure as set forth in claim 3, wherein said inter-connecting peripheral rib and recess are continuously connected around the peripheral edge of said closure member and of said container when said closure member is in its said closed position to thereby provide a water tight seal therearound.

7. A padlock enclosure comprising a three dimensional container having a peripheral side wall joined along a first peripheral edge to a protective wall extending transversely of said peripheral side wall, said peripheral side wall having a second peripheral edge spaced apart from said first peripheral edge, an open container wall defined by said second peripheral edge spaced apart from said protective wall and extending transversely of said peripheral side wall, a three dimensional cavity of said container to receive a padlock therein bounded by said peripheral side wall, said protective wall and said open container wall, a closure member connected to said container movable between a closed position and an open position, said closure member including a substantially planar panel having a peripheral configuration and dimension corresponding to that of said open container wall to close it when said closure member is in its said closed position and to open said open container wall when in its said open position, closure member connecting means to connect said closure member to said container, releasable holding means to releasably hold said closure member in its said closed position, a first receiving aperture through said panel of said closure member having a dimension and configuration to receive a lockable loop member therethrough, a first receiving aperture cover movable between a closed position to close said first receiving aperture and an opening position to open said first receiving aperture, and first cover connecting means to connect said first receiving aperture cover to said first receiving aperture, wherein said first receiving aperture cover has a peripheral configuration and dimension corresponding to that of said first receiving aperture, said first cover connecting means comprising an integral flexible cover hinge along one edge portion of said first receiving aperture cover connecting it to a corresponding edge portion of said first receiving aperture, said integral flexible cover hinge terminating at a first end and at an opposite second end, a connecting web extending peripherally between and integrally joining that part of the peripheral edge of said first receiving aperture cover which extends away from said first end of said integral flexible cover hinge and around to said second end thereof to the corresponding part of the peripheral edge of said first receiving aperture, said connecting web having a cross-sectional thickness which is less than the cross-sectional thickness of said panel of said closure member and of said first receiving aperture cover to enable separating said first receiving aperture cover from said first receiving aperture along portions of said connecting web at which separating pressure is applied to thereby open said first receiving aperture.

8. A padlock enclosure comprising a three dimensional container having a peripheral side wall joined along a first peripheral edge to a protective wall extending transversely of said peripheral side wall, said peripheral side wall having a second peripheral edge spaced apart from said first peripheral edge, an open container wall defined by said second peripheral edge spaced apart from said protective wall and extending transversely of said peripheral side wall, a three dimensional cavity of said container to receive a padlock therein bounded by said peripheral side wall, said protective wall and said open container wall, a closure member connected to said container movable between a closed position and an open position, said closure member including an imperforate wall having a peripheral edge with a configuration and dimension corresponding to that of said second peripheral edge of said container to close said open container wall when said closure member is in its said closed position and to open said open container wall when in its said open position, closure member connecting means to connect said closure member to said container, releasable holding means to releasably hold said closure member in its said closed position, a first receiving aperture through said protective wall of said container having a dimension and configuration to receive a lockable loop member therethrough, a first receiving aperture cover movable between a closed position to close said first receiving aperture and an open position to open said first receiving aperture, and first cover connecting means to connect said first receiving aperture cover to said first receiving aperture, wherein said first receiving aperture cover has a peripheral configuration and dimension corresponding to that of said first receiving aperture, said first cover connecting means comprising a connecting web extending peripherally between and integrally joining the peripheral edge of said first receiving aperture cover to the corresponding peripheral edge of said first receiving aperture, said connecting web having a cross-sectional thickness of which is less than the cross-sectional thickness of said protective wall of said container and of said first receiving aperture cover to enable separating said first receiving aperture cover from said first receiving aperture along portions of said connecting web at which separating pressure is applied to thereby open said first receiving aperture.

9. A padlock enclosure comprising a three dimensional container having a peripheral side wall joined along a first peripheral edge to a protective wall extending transversely of said peripheral side wall, said peripheral side wall having a second peripheral edge spaced apart from said first peripheral edge, an open container wall defined by said second peripheral edge spaced apart from said protective wall and extending transversely of said peripheral side wall, a three dimensional cavity of said container to receive a padlock therein bounded by said peripheral side wall, said protective wall and said open container wall, a closure member connected to said container movable between a closed position and an open position, said closure member including an imperforate wall having a peripheral edge with a configuration and dimension corresponding to that of said second peripheral edge of said container to close said open container wall when said closure member is in its said closed position and to open said open container wall when in its said open position, closure member connecting means to connect said closure member to said container, releasable holding means to releasably hold said closure member in its said closed position, a first receiving aperture through said protective wall of said container having a dimension and configuration to receive a lockable loop member therethrough, a first receiving aperture cover movable between a closed position to close said first receiving aperture and an open position to open said first receiving aperture, and first cover connecting means to connect said first receiving aperture cover to said first receiving aperture, wherein said first receiving aperture cover has a peripheral configuration and dimension corresponding to that of said first receiving aperture, said first cover connecting means comprising an integral flexible cover hinge along one edge portion of said first receiving aperture cover connecting it to a corresponding edge portion of said first receiving aperture, said integral flexible cover hinge terminating at a first end and at an opposite second end, a connecting web extending peripherally between and integrally joining that part of the peripheral edge of said first receiving aperture cover which extends away from said first end of said integral flexible cover hinge and around to said second end thereof to the corresponding part of the peripheral edge of said first receiving aperture, said connecting web having a cross-sectional thickness which is less than the cross-sectional thickness of said protective wall of said container and of said first receiving aperture cover to enable separating said first receiving aperture cover from said first receiving aperture along portions of said connecting web at which separating pressure is applied to thereby open said first receiving aperture.

10. A padlock enclosure comprising a three dimensional container having a peripheral side wall joined along a first peripheral edge to a protective wall extending transversely of said peripheral side wall, said peripheral side wall having a second peripheral edge spaced apart from said first peripheral edge, an open container wall defined by said second peripheral edge spaced apart from said protective wall and extending transversely of said peripheral side wall, a three dimensional cavity of said container to receive a padlock therein bounded by said peripheral side wall, said protective wall and said open container wall, a closure member connected to said container movable between a closed position and an open position, said closure member including a substantially planar panel having a peripheral configuration and dimension corresponding to that of said open container wall to close it when said closure member is in its said closed position and to open said open container wall when in its said open position, closure member connecting means to connect said closure member to said container, releasable holding means to releasably hold said closure member in its said closed position, a first receiving aperture through said panel of said closure member having a dimension and configuration to receive a lockable loop member therethrough, a first receiving aperture cover movable between a closed position to close said first receiving aperture and an open position to open said first receiving aperture, and first cover connecting means to connect said first receiving aperture cover to said first receiving aperture, wherein said first receiving aperture includes an upper edge and a spaced apart lower edge, said upper edge being above said lower edge when a said lockable loop member is received therethrough, a drain aperture through said panel of said closure member positioned below said upper and lower edges of said first receiving aperture, a drain aperture cover movable between a closed position to close said drain aperture and an open position to open said drain aperture, said drain aperture having an upper edge and a lower edge, and drain cover connecting means to connect said drain aperture cover to said drain aperture.

11. A paddock enclosure as set forth in claim 10, wherein said drain aperture cover has a peripheral configuration and dimension corresponding to that of said drain aperture, said drain cover connecting means comprising an integral flexible drain cover hinge along said lower edge of said drain aperture connecting it to a corresponding lower edge portion of said drain aperture cover, said integral flexible drain cover hinge terminating at a first end and at an opposite second end, a connecting web extending peripherally between and integrally joining that part of the peripheral edge of said drain aperture cover which extends away from said first end of said integral flexible drain cover hinge and around to said second end thereof to the corresponding part of the peripheral edge of said drain aperture when said drain aperture cover is in its closed position, said connecting web having a cross-sectional thickness of which is less than the cross-sectional thickness of said panel of said closure member and of said drain aperture cover to enable separating said drain aperture cover from said drain aperture along portions of said connecting web at which separating pressure is applied to thereby open said drain aperture, said drain aperture cover when moved to its said open position extends at an inclined angle upwardly from its integral connection along its said lower edge portion to said integral flexible drain cover hinge and inclining in the direction toward said container.

12. A padlock enclosure comprising a three dimensional container having a peripheral side wall joined along a first peripheral edge to a protective wall extending transversely of said peripheral side wall, said peripheral side wall having a second peripheral edge spaced apart from said first peripheral edge, an open container wall defined by said second peripheral edge spaced apart from said protective wall and extending transversely of said peripheral side wall, a three dimensional cavity of said container to receive a padlock therein bounded by said peripheral side wall, said protective wall and said open container wall, a closure member connected to said container movable between a closed position and an open position, said closure member including an imperforate wall having a peripheral edge with a configuration and dimension corresponding to that of said second peripheral edge of said container to close said open container wall when said closure member is in its said closed position and to open said open container wall when in its said open position, closure member connecting means to connect said closure member to said container, releasable holding means to releasably hold said closure member in its said closed position, a first receiving aperture through said protective wall of said container having a dimension and configuration to receive a lockable loop member therethrough, a first receiving aperture cover movable between a closed position to close said first receiving aperture and an open position to open said first receiving aperture, and first cover connecting means to connect said first receiving aperture cover to said first receiving aperture, wherein said first receiving aperture includes an upper edge and a spaced apart lower edge, said upper edge being above said lower edge when a said staple of a said hasp is received therethrough, a drain aperture through said protective wall of said container positioned below said upper and lower edges of said first receiving aperture, a drain aperture cover movable between a closed position to close said drain aperture and an open position to open said drain aperture, said drain aperture having an upper edge and a lower edge, and drain cover connecting means to connect said drain aperture cover to said drain aperture.

13. A paddock enclosure as set forth in claim 12, wherein said drain aperture cover has a peripheral configuration and dimension corresponding to that of said drain aperture, said drain cover connecting means comprising an integral flexible drain cover hinge along said lower edge of said drain aperture connecting it to a corresponding lower edge portion of said drain aperture cover, said integral flexible drain cover hinge terminating at a first end and at an opposite second end, a connecting web extending peripherally between and integrally joining that part of the peripheral edge of said drain aperture cover which extends away from said first end of said integral flexible drain cover hinge and around to said second end thereof to the corresponding part of the peripheral edge of said drain aperture when said drain aperture cover is in its closed position, said connecting web having a cross-sectional thickness of which is less than the cross-sectional thickness of said protective wall of said container and of said drain aperture cover to enable separating said drain aperture cover from said drain aperture along portions of said connecting web at which separating pressure is applied to thereby open said drain aperture, said drain aperture cover when moved to its said open position extends at an inclined angle upwardly from its integral connection along its said lower edge portion to said integral flexible drain cover hinge and inclining in the direction toward said closure member.

* * * * *